US006053779A

United States Patent [19]

Liang

[11] Patent Number: 6,053,779

[45] Date of Patent: Apr. 25, 2000

[54] TERMINAL CLAMP AND ELECTRICAL WIRE MOUNTING ARRANGEMENT

[76] Inventor: Shih-Tsung Liang, No. 10, Lane 31, Ta-Feng St., Lu-Chu Hsiang Taoyuan County, Taiwan

[21] Appl. No.: 09/215,177

[22] Filed: Dec. 18, 1998

[51] Int. Cl.[7] ..... H01R 11/01; H01R 4/42

[52] U.S. Cl. ..... 439/756; 439/762

[58] Field of Search ..... 439/754, 756, 439/757, 758, 762, 765, 771, 763, 764

[56] References Cited

U.S. PATENT DOCUMENTS

| | | | |
|---|---|---|---|
| 3,389,368 | 6/1968 | Schaefer | 439/522 |
| 3,505,636 | 4/1970 | McDowell | 439/758 |
| 3,739,322 | 6/1973 | Haegert | 439/764 |
| 3,893,744 | 7/1975 | Porazinski | 439/763 |
| 5,316,505 | 5/1994 | Kipp | 439/762 |
| 5,407,369 | 4/1995 | Oster | 439/762 |
| 5,445,907 | 8/1995 | Ito et al. | 429/178 |
| 5,558,545 | 9/1996 | Staab et al. | 439/762 |
| 5,934,947 | 8/1999 | Liang | 439/762 |

FOREIGN PATENT DOCUMENTS

| | | | |
|---|---|---|---|
| 2 456 401 | 5/1979 | France | H01R 4/42 |

*Primary Examiner*—Lincoln Donovan
*Assistant Examiner*—Michael C. Zarroli
*Attorney, Agent, or Firm*—Rosenberg, Klein & Lee

[57] ABSTRACT

A terminal clamp and electrical wire mounting arrangement includes a metal clamp, the clamp having a smoothly arched clamping head attached to a connector at a storage battery, and first and second clamping arms extended from two opposite ends of the clamping head, a metal holding down plate coupled to one clamping arm of the clamp to hold down an electrical wire, and a screw bolt inserted through a through hole at the holding down plate and a through hole at the first clamping arm of the clamp and threaded into the screw hole at the second clamping arm of the clamp to fix the holding down plate to the first clamping arm, and close the first and second clamping arms together, enabling the clamp to be firmly secured to the connector at the storage battery.

5 Claims, 6 Drawing Sheets

TERMINAL CLAMP AND ELECTRICAL WIRE MOUNTING ARRANGEMENT

BACKGROUND OF THE INVENTION

The present invention relates to a terminal clamp and electrical wire mounting arrangement which uses a screw bolt to fasten a metal holding down plate to a metal clamp, enabling the metal clamp to be fixed to a connector at a storage battery, and an electrical wire to be simultaneously fixed to the metal clamp upon fixation of the metal clamp to the connector at the storage battery.

FIG. 9 show a terminal clamp and electrical wire mounting arrangement according to the prior art. This arrangement comprises a metal clamp 5, the metal clamp 5 having two parallel clamping arms 53 at a front side and a mounting hole at the rear side, an electrical wire 55, the electrical wire 55 having a terminal 51 fastened to the mounting hole at the rear side of the metal clamp 5 by a screw and a wing nut 52, and a screw bolt 54 mounted in respective through holes at the clamping arms 53 and screwed up with a nut to fix the clamping arms 53 together. This arrangement is not satisfactory in function. Because the wing nut 52 tends to be loosened from the corresponding screw, the terminal 51 of the electrical wire 55 may not be firmly secured in place, causing a current loss.

FIGS. 10 and 11 show another terminal clamp and electrical wire mounting arrangement according to the prior art. This arrangement comprises a metal clamp 6, the metal clamp 6 having a smoothly arched clamping head 61 on the middle, two clamping arms 62 forwardly extended from two opposite ends of the smoothly arched clamping head 61, a screw bolt 63 mounted in holes at the clamping arms 62 to close the clamping arms 62 and secure the clamping head 61 to a connector at a storage battery, a wire mount 64 at a rear side, the wire mount 64 having a wire groove 641 at its top side wall on the middle, and a holding down plate 65 closely attached to the top side wall of the wire mount 64 to hold down the conductors of an electrical wire 3 in the wire groove 641, and two screws 651 installed in respective holes at the holding down plate 65 and the wire mount 64 to fix the holding down plate 65 and the wire mount 64 together. This structure of terminal clamp and electrical wire mounting arrangement is complicated. Further, the electrical wire 3 tends to be disconnected from the clamp 4 and the holding down plate 65 when stretched axially.

SUMMARY OF THE INVENTION

The present invention has been accomplished to provide a terminal clamp and electrical wire mounting arrangement which eliminates the aforesaid drawbacks. According to one aspect of the present invention, the terminal clamp and electrical wire mounting arrangement comprises a metal clamp, the clamp having a smoothly arched clamping head attached to a connector at a storage battery, and first and second clamping arms extended from two opposite ends of the clamping head, a metal holding down plate coupled to one clamping arm of the clamp to hold down an electrical wire, and a screw bolt inserted through a through hole at the holding down plate and a through hole at the first clamping arm of the clamp and threaded into the screw hole at the second clamping arm of the clamp to fix the holding down plate to the first clamping arm, and close the first and second clamping arms together, enabling the clamp to be firmly secured to the connector at the storage battery. According to another aspect of the present invention, the first clamping arm has parallel grooves at one side wall thereof, and the holding down plate has corrugated portions at a convex wall thereof, which are pressed on the conductors of the electrical wire against the parallel grooves at the first clamping arm to hold down the electrical wire after fixation of the holding down plate to the clamp by the screw bolt. According to still another aspect of the present invention, the holding down plate has two side flanges perpendicularly raised from two lateral sides thereof, and respectively attached to the top and bottom side walls of the first clamping arm of the clamp.

DETAILED DESCRIPTION OF THE PREFERRED EMBODIMENT

Figure 1:
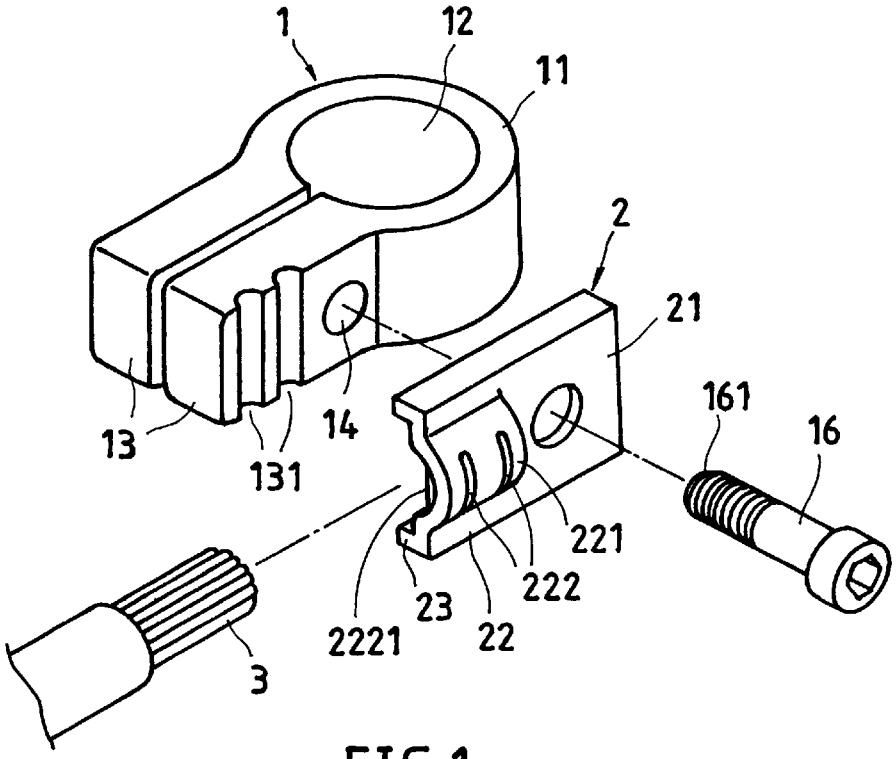
FIG. 1 is an exploded view of a terminal clamp and electrical wire mounting arrangement according to a first embodiment of the present invention.
Figure 2:
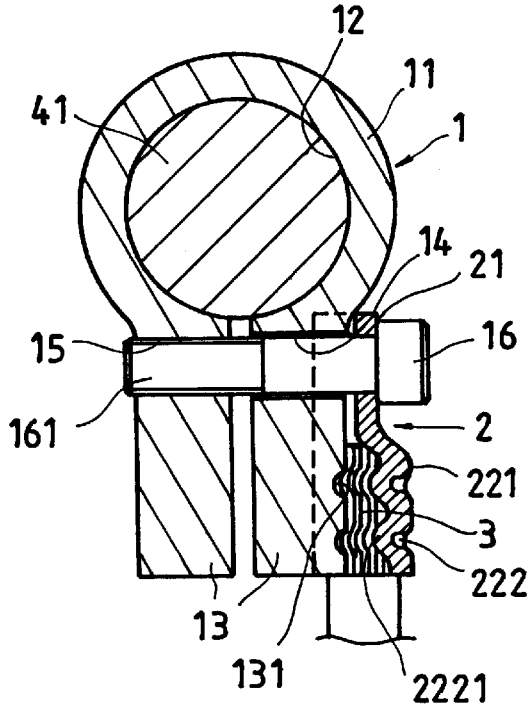
FIG. 2 is a sectional assembly view of FIG. 1.
Figure 3:
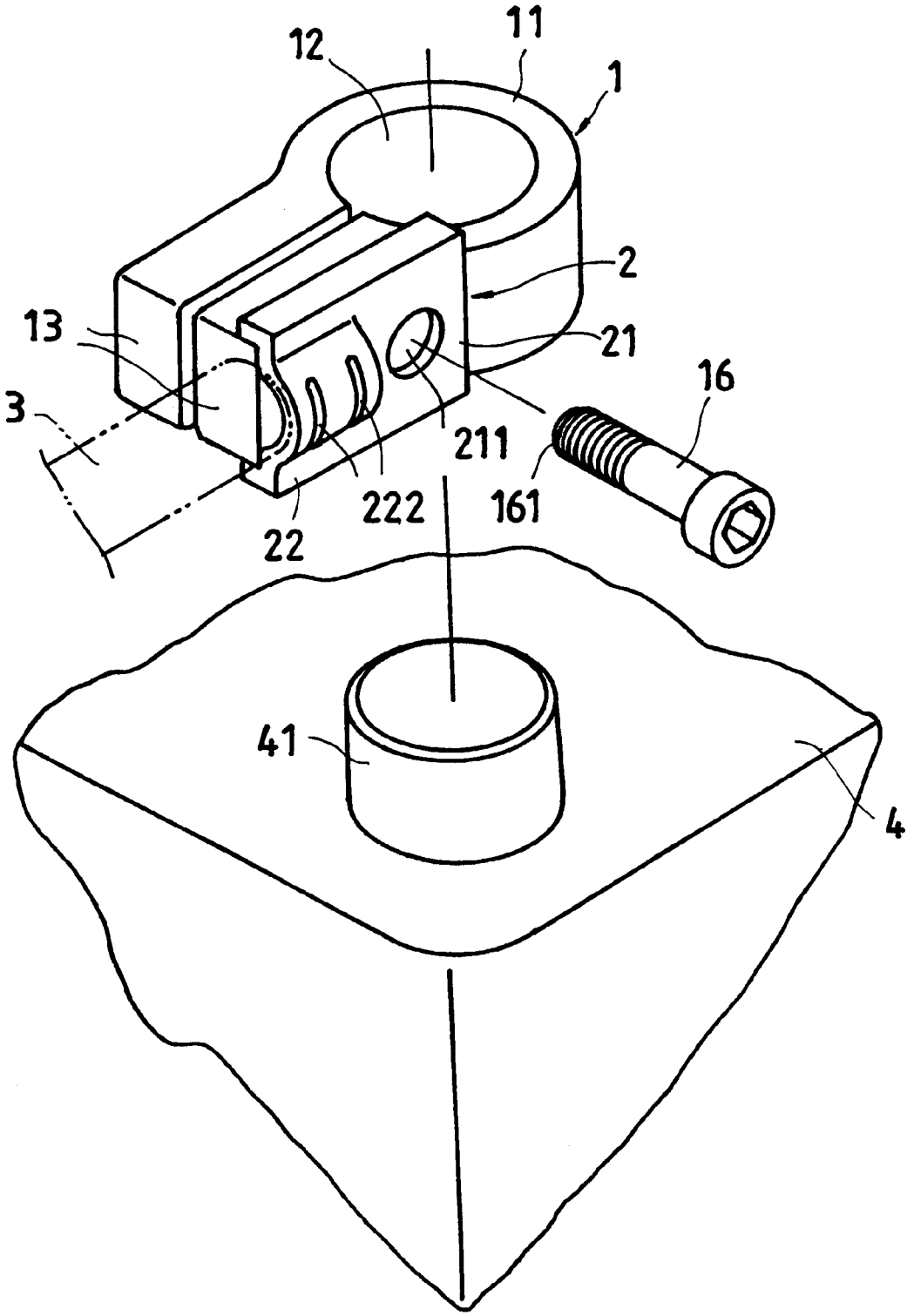
FIG. 3 illustrates the relationship between the first embodiment of the present invention and a connector at a storage battery.

Referring to Figures from 1 through 3, a terminal clamp and electrical wire mounting arrangement in accordance with the present invention comprises a metal terminal clamp 1, a metal holding down plate 2, and an electrical wire 3. The clamp 1 comprises a smoothly arched clamping head 11, two parallel clamping arms 13 extended from two opposite ends of the smoothly arched clamping head 11 in one direction, a clamping hole 12 defined within the smoothly arched clamping head 11, a transverse through hole 14 at one clamping arm 13, a screw hole 15 at the other clamping arm 13 in alignment with the transverse through hole 14, and a plurality of parallel grooves 131 at one clamping arm 13 where the transverse through hole 14 is provided. The metal holding down plate 2 comprises a through hole 211 at the front half 21 thereof, a convex wall 221 at the rear half 22 thereof, two side flanges 23 perpendicularly raised from two opposite lateral sides thereof in same direction, and corrugated portions 222 provided at the convex wall 221. When the smoothly arched clamping head 11 of the clamp 1 is attached to a connector 41 at a storage battery 4, the conductors at one end of the electrical wire 3 are attached to one clamping arm 13 at one side, then the holding down plate 2 is covered on the conductors of the electrical wire 3 at one side of the corresponding clamping arm 13 with the two side flanges 23 of the holding down plate 2 closely attached to top and bottom side walls of the corresponding clamping arm 13, permitting the conductors of the electrical wire 3 to be clamped between the grooves 131 at the corresponding clamping arm 13 and the bottom edges 2221 of the corrugated portions 222, and then a screw bolt 16 is installed in the transverse through hole 14 with its threaded stem 161 threaded into the screw hole 15 at the other clamping arm 13 of the clamp 1 to tightly secure the clamp 1 to the connector 41 of the storage battery 4 and the holding down plate 2 to the clamp 1, and therefore the electrical wire 3 is firmly secured to the clamp 1.

Figure 4:
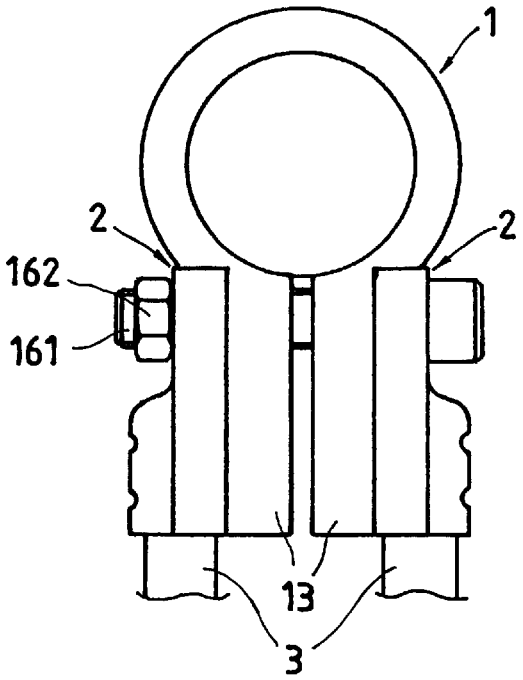
FIG. 4 illustrates an alternate form of the present invention.

FIG. 4 shows an alternate form of the present invention. According to this alternate form, two holding down plates 2 are fastened to the two clamping arms 13 of the clamp 1 at two opposite sides by a screw bolt 16 and a nut 162 to secure two electrical wires 3 to the clamping arms 13. The nut 162 is threaded onto the threaded stem 161 of the screw bolt 16.

Figure 5:
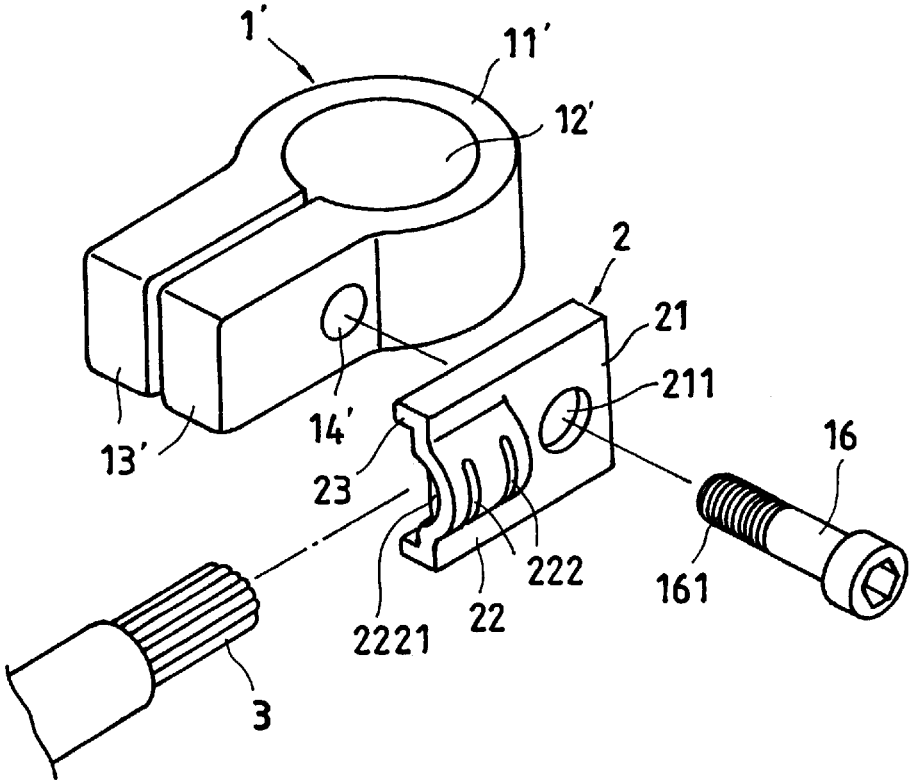
FIG. 5 is an exploded view of another alternate form of the present invention.
Figure 6:
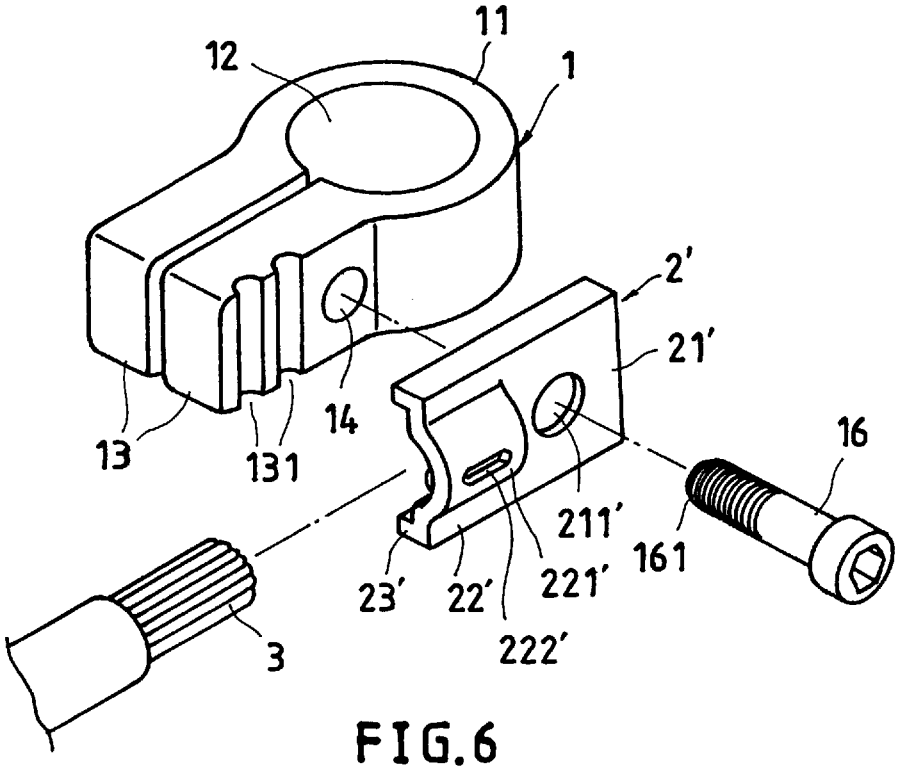
FIG. 6 is an exploded view of still another alternate form of the present invention.
Figure 7:
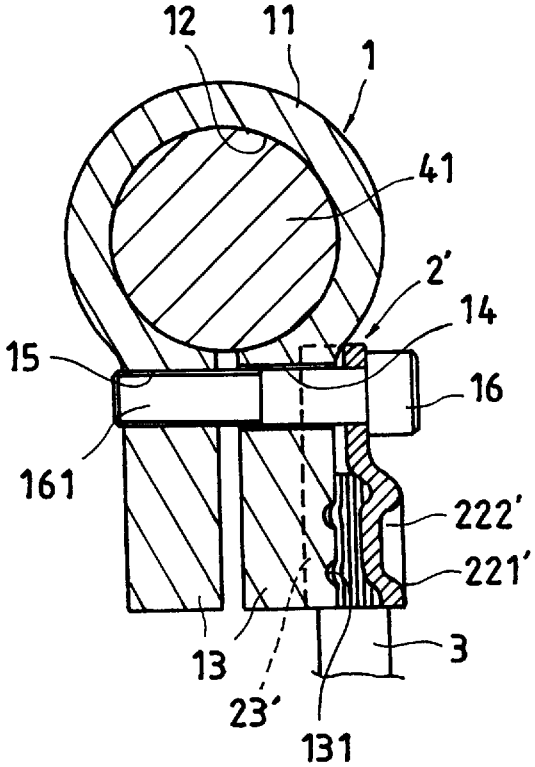
FIG. 7 is a sectional assembly view of the embodiment shown in FIG. 6.
Figure 8:
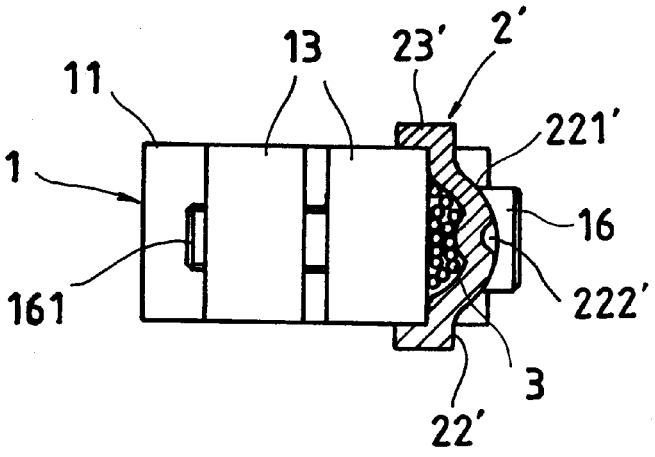
FIG. 8 is a cross sectional view of the embodiment shown in FIG. 7.
Figure 9:
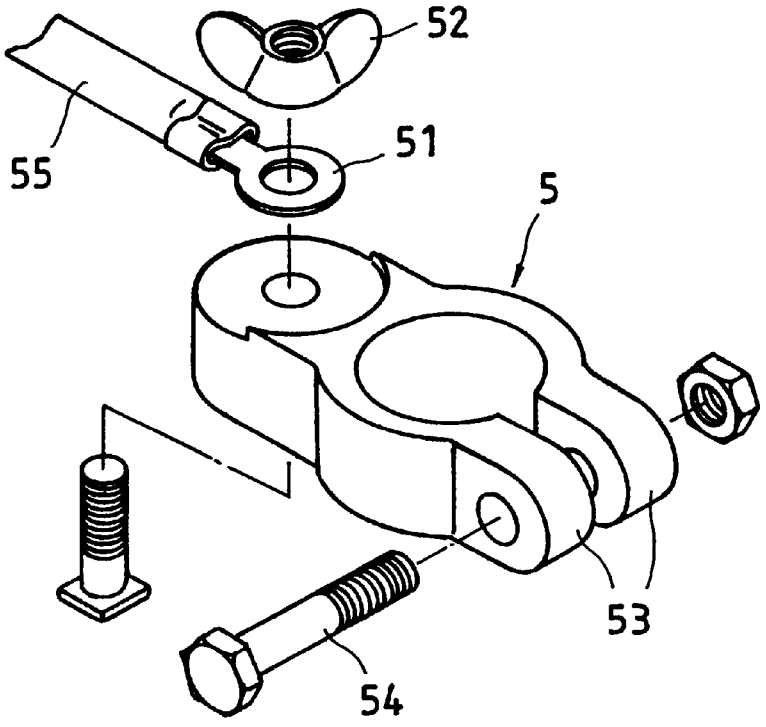
FIG.9 PRIOR ART
FIG. 9 is an exploded view of a terminal clamp and electrical wire mounting arrangement according to the prior art.
Figure 10:
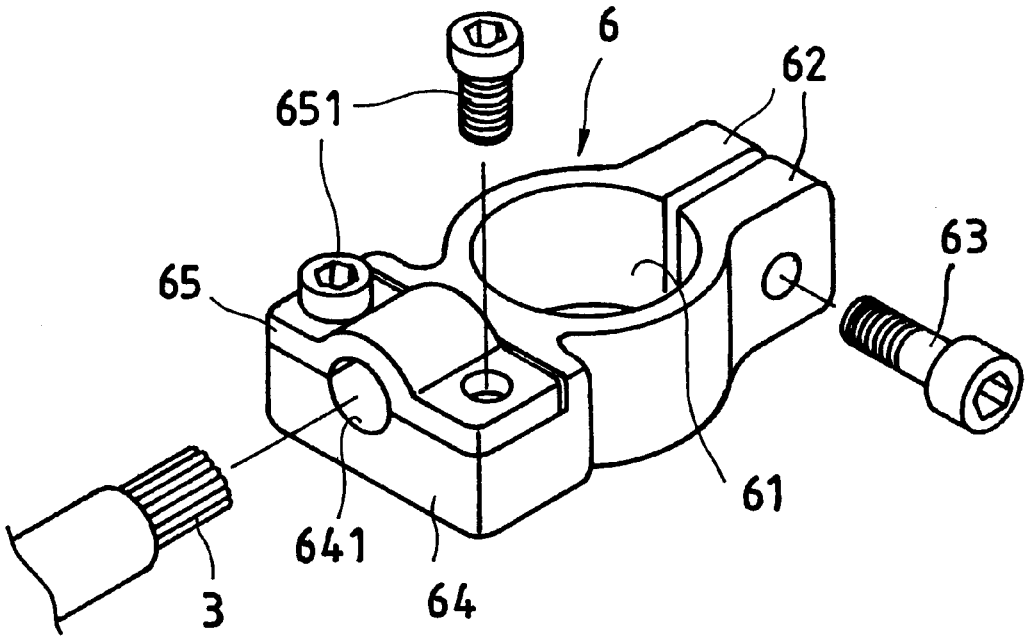
FIG.10 PRIOR ART
FIG. 10 is an exploded view of another terminal clamp and electrical wire mounting arrangement according to the prior art.
Figure 11:
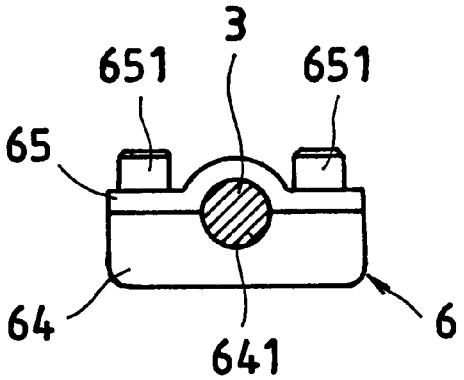
FIG.11 PRIOR ART
FIG. 11 is a sectional assembly view in a reduced scale of the arrangement shown in FIG. 10.

FIG. 5 shows another alternate form of the present invention. According to this embodiment, the holding down plate 2 is identical to that shown in FIG. 1, however the clamp 1' eliminates the aforesaid parallel grooves 131. When the screw bolt 16 is installed in the through hole 211 at the holding down plate 2 and the through hole 14' and the screw hole 15' (not shown) at the clamping arms 13', the clamping arms 13' are closed together, and the bottom edges 2221 of the corrugated portions 222 of the holding down plate 2 are pressed on the conductors of the electrical wire 3 against the flat outside wall of the corresponding clamping arm 13' of the clamp 1', enabling the electrical wire 3 to be firmly secured to the clamp 1' by the holding down plate 2.

Figures from 6 through 8 show still another alternate form of the present invention. According to this embodiment, the metal holding down plate 2' comprises a through hole 211' at the front half 21' thereof, two side flanges 23' perpendicularly raised from two opposite lateral sides thereof in same direction, a convex wall 221' at the rear half 22' thereof, and at least one longitudinally extended, elongated recessed portion 222' at the convex wall 221'. After installation of the screw bolt 16 to fix the holding down plate 2' to the clamp 1, the side flanges 23' of the holding down plate 2' are closely attached to top and bottom side walls of the corresponding clamping arm 13, and the at least one longitudinally extended, elongated recessed portion 222' is pressed on the conductors of the electrical wire 3 against the parallel grooves 131 at one clamping arm 13 of the clamp 1, thereby causing the electrical wire 3 to be firmly secured to the clamp 1.

It is to be understood that the drawings are designed for purposes of illustration only, and are not intended as a definition of the limits and scope of the invention disclosed.

What the invention claimed is:

1. A terminal clamp and electrical wire mounting arrangement comprising:

a metal clamp, said metal clamp comprising a smoothly arched clamping head, a first clamping arm and a second clamping arm respectively extended from two opposite ends of said smoothly arched clamping head in one direction, a clamping hole defined within said smoothly arched clamping head for receiving a connector at a storage battery, a transverse through hole at said first clamping arm, a screw hole at said second clamping arm in alignment with said transverse through hole;

a metal holding down plate fastened to said first clamping arm of said clamp to hold down conductors of an electrical wire, said holding down plate comprising a through hole at a front half thereof aligned with the transverse through hole at said first clamping arm, a convex wall at a rear half thereof, two side flanges perpendicularly raised from two opposite lateral sides thereof in same direction and respectively attached to top and bottom side walls of said first clamping arm, and corrugated portions provided at said convex wall and pressed on the conductors of the installed electrical wire against one side wall of said first clamping arm; and a screw bolt inserted into the through hole at said holding down plate and the transverse through hole at said first clamping arm, and threaded into the screw hole at said second clamping arm to fix said holding down plate to said first clamping arm, and secure said first clamping arm and said second clamping arm together, enabling said clamp to be fixed to the connector at the storage battery.

2. The terminal clamp and electrical wire mounting arrangement of claim 1 wherein said first clamping arm of said clamp comprises a plurality of parallel grooves disposed at one side wall of said first clamping arm and pressed on the conductors of the installed electrical wire against the corrugated portions of said holding down plate.

3. A terminal clamp and electrical wire mounting arrangement comprising:

a metal clamp, said metal clamp comprising a smoothly arched clamping head, a first clamping arm and a second clamping arm respectively extended from two opposite ends of said smoothly arched clamping head in one direction, a clamping hole defined within said smoothly arched clamping head for receiving a connector at a storage battery, a transverse through hole at said first clamping arm, a screw hole at said second clamping arm in alignment with said transverse through hole;

a metal holding down plate fastened to said first clamping arm of said clamp to hold down conductors of an electrical wire, said holding down plate comprising a through hole at a front half thereof aligned with the transverse through hole at said first clamping arm, a convex wall at a rear half thereof, two side flanges perpendicularly raised from two opposite lateral sides thereof in same direction and respectively attached to top and bottom side walls of said first clamping arm, and at least one longitudinally extended, elongated recessed portion provided at said convex wall and pressed on the conductors of the installed electrical wire against one side wall of said first clamping arm; and a screw bolt inserted into the through hole at said holding down plate and the transverse through hole at said first clamping arm, and threaded into the screw hole at said second clamping arm to fix said holding down plate to said first clamping arm, and secure said first clamping arm and said second clamping arm together, enabling said clamp to be fixed to the connector at the storage battery.

4. The terminal clamp and electrical wire mounting arrangement of claim 3 wherein said first clamping arm of said clamp comprises a plurality of parallel grooves disposed at one side wall of said first clamping arm and pressed on the conductors of the installed electrical wire against the at least one longitudinally extended, elongated recessed portion of said holding down plate.

5. A terminal clamp and electrical wire mounting arrangement comprising:

a metal clamp, said metal clamp comprising a smoothly arched clamping head defining a clamping hole for receiving a connector at a storage battery, and two parallel clamping arms respectively extended from two opposite ends of said smoothly arched clamping head in one direction, said clamping arms each comprising a transverse through hole aligned with each other;

two metal holding down plates respectively fastened to said clamping arms of said clamp to hold down conductors of two electrical wires at two opposite sides of said clamp, said holding down plates each comprising a through hole aligned with the transverse through holes at said clamping arms, a convex wall, two side flanges perpendicularly disposed at two opposite lateral sides and respectively attached to top and bottom side walls of said clamping arms, and at least one longitudinally extended, elongated recessed portion provided at said convex wall and pressed on the conductors of the installed electrical wires against the respective clamping arms; and a screw bolt inserted into the through holes at said holding down plates and the transverse through holes at said clamping arms and screwed up with a nut to fix said holding down plates to said clamping arms, and secure said clamping arms together, enabling said clamp to be fixed to the connector at the storage battery.

* * * * *